US008152323B2

(12) United States Patent
Bushee

(10) Patent No.: US 8,152,323 B2
(45) Date of Patent: Apr. 10, 2012

(54) TACTICAL LIGHTING SYSTEM

(75) Inventor: Glenn Bushee, Duxbury, MA (US)

(73) Assignee: Glenn Bushee, Duxbury, MA (US)

( * ) Notice: Subject to any disclaimer, the term of this patent is extended or adjusted under 35 U.S.C. 154(b) by 160 days.

(21) Appl. No.: 12/386,907

(22) Filed: Apr. 23, 2009

(65) Prior Publication Data

US 2009/0251889 A1 Oct. 8, 2009

Related U.S. Application Data

(63) Continuation-in-part of application No. 12/074,846, filed on Feb. 28, 2008, now abandoned.

(60) Provisional application No. 60/920,633, filed on Mar. 28, 2007.

(51) Int. Cl.
*A45B 3/02* (2006.01)
*F42B 8/08* (2006.01)

(52) U.S. Cl. ..... 362/112; 362/267; 102/502

(58) Field of Classification Search ..... 362/111, 362/112, 249.05, 267; 102/355, 361, 498, 102/502, 513

See application file for complete search history.

(56) References Cited

U.S. PATENT DOCUMENTS

| | | | | | |
|---|---|---|---|---|---|
| 2,903,820 | A * | 9/1959 | Bodell | 446/439 |
| 3,304,651 | A * | 2/1967 | Deyerl | 446/439 |
| 3,596,078 | A * | 7/1971 | Owens | 362/184 |
| 3,610,916 | A * | 10/1971 | Meehan | 362/363 |
| 4,985,813 | A * | 1/1991 | Putman | 362/186 |
| 5,066,011 | A * | 11/1991 | Dykstra et al. | 473/570 |
| 5,488,795 | A * | 2/1996 | Sweat | 42/116 |
| D419,247 | S * | 1/2000 | Kessler | D26/1 |
| 7,093,962 | B2 * | 8/2006 | Mahoney | 362/363 |
| 7,128,454 | B2 * | 10/2006 | Kim et al. | 362/507 |
| 7,682,053 | B2 * | 3/2010 | Shen | 362/373 |
| 7,926,986 | B2 * | 4/2011 | Shen | 362/373 |
| 2005/0094395 | A1 * | 5/2005 | Rosenberg | 362/249 |
| 2008/0158856 | A1 * | 7/2008 | Shen | 362/84 |

* cited by examiner

*Primary Examiner* — John A Ward
(74) *Attorney, Agent, or Firm* — Lawrence J. Shurupoff

(57) ABSTRACT

Portable projectable infrared lights are used to mark and illuminate dark areas such as rooms in a building or cells in a prison. The lights cannot be seen with the unaided eye but are brilliantly visible with the aid of night vision goggles and similar infrared receivers and light transducers which convert infrared light to visible light. In those cases where potentially hostile individuals are equipped with night vision apparatus, the infrared lights can be used to temporarily blind, stun and/or disorient them.

4 Claims, 3 Drawing Sheets

TACTICAL LIGHTING SYSTEM

CROSS REFERENCE TO RELATED APPLICATIONS

This application is a Continuation-In-Part application of application Ser. No. 12/074,846 filed Feb. 28, 2008 now abandoned for Tactical Lighting System, which is incorporated herein by reference in its entirety, the benefit and priority of which are hereby claimed and which claimed the benefit and priority of U.S. Provisional Application No. 60/920,633 filed Mar. 28, 2007 entitled Tactical Lighting System.

BACKGROUND AND SUMMARY

The present disclosure relates to portable lights which can be used to stun, temporarily blind and disorient an individual. Such lights can be used in police, military and civilian applications where it is necessary to distract, temporarily disorient and even disable a person without causing permanent harm to the person or property.

The portable lights can be used as a supplement to or substitute for conventional flash grenades. A common problem with flash grenades is that they are incendiary and have been known to cause fires as well as burns and other bodily injuries. The portable light disclosed herein can be a battery-operated high-intensity light. One type of light source which has been found to be effective is a white light-emitting-diode (LED).

Because an LED light source is derived from low temperature semiconductors, there is no chance of starting a fire or causing burns. Moreover, the battery-powered light can be economically reused many times, if desired. This is particularly useful when practicing various tactics using the lights.

While the lights are adapted to be thrown by hand, either individually or in sets or groups of two or more, the lights may be projected by any other suitable means from a device as simple as a slingshot to a long-range gas ($CO_2$)-powered launcher, such as used to fire paint-balls. Spring-powered launchers and gunpowder-powered launchers can also be used to fire individual lights, or groups of lights.

Various other objects, features and attendant advantages of the present disclosure will be more fully appreciated as the same becomes better understood from the following detailed description.

DESCRIPTION OF THE EMBODIMENTS

Figure 1:
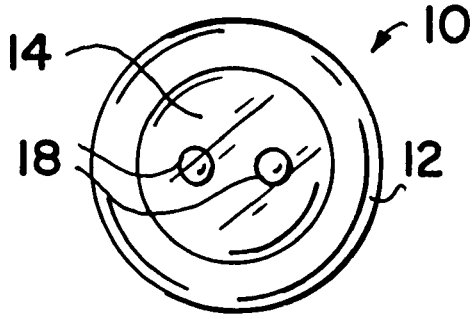
FIG. 1 is a front elevation view of an example of one type of light that can be used for tactical purposes.
Figure 2:
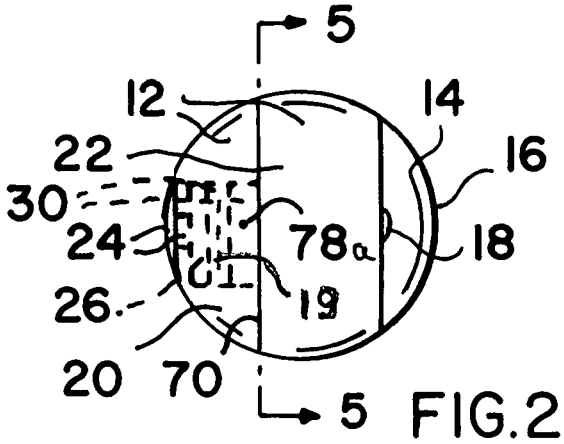
FIG. 2 is a left side elevation view of the light of FIG. 1 showing batteries and an on-off switch in dash lines.
Figure 3:
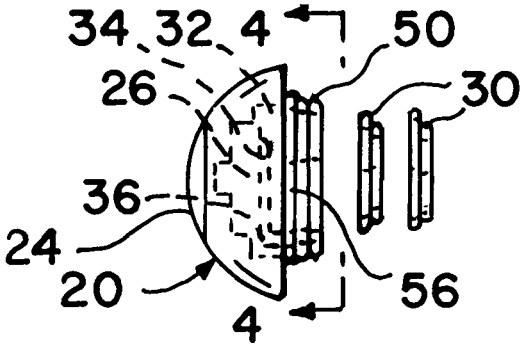
FIG. 3 is a partially-exploded left side elevation view of the base portion of FIG. 2.
Figure 4:
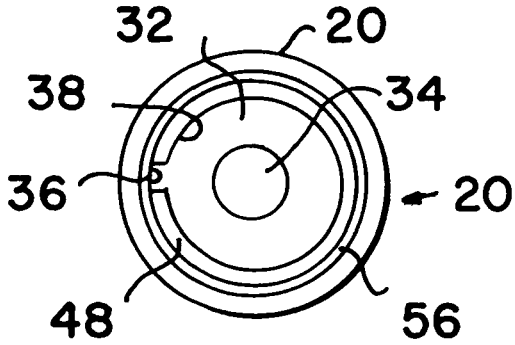
FIG. 4 is view along line 4-4 of FIG. 3.
Figure 5:
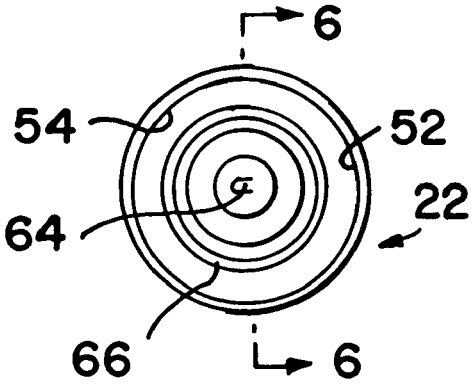
FIG. 5 is a view of the top portion of the light, taken along line 5-5 of FIG. 2.

As seen in FIG. 1, a light 10 is constructed with a substantially spherical housing 12 to allow the light to roll and wobble across a floor or other surface. A clear, transparent lens or light cover 14 having an outer spherical surface portion 16 (FIG. 2) extends over one or more light sources 18 and forms a portion of housing 12. Light sources 18 can be electric lights such as incandescent lamps or solid state lamps such as LEDS.

The housing 12 includes a first or bottom portion 20 and a second or top portion 22, as seen in FIGS. 2 through 6. The bottom portion 20 includes a depressable spring-biased switch actuator 24, which can be selectively depressed and released to turn the light sources 18 on and off via snap-action switch 26. Switch 26 can include a strobe light circuit 19 (FIG. 2) that causes the light sources 18 to continually and rapidly pulse on and off in a flashing manner. This function serves to increase the disorienting effect produced by the light 10. The strobe light circuit 19 can be designed to terminate the strobe effect upon a second actuation of switch 26.

One or more batteries, such as button batteries 30, are nested within a pocket 32 (FIG. 4) to engage an electrical contact 34 on switch 26. A second electrical contact 36 extends upwardly along the inner sidewall 38 of a tubular wall 48. Wall 48 includes external screw threads 50 (FIG. 3) which mate with screw threads 52 (FIGS. 5 and 6) formed in the inner wall 54 of the top potion 22 of housing 12. An elastomeric 0-ring 56 is provided around the base of wall 48 to provide a water-tight seal between the bottom and top housing portions 20, 22.

The top housing portion 20 further includes a parabolic mirror 60 centered around the light sources 18. An insulator plate 62 supports the light sources 18. A first electrical contact 64 is connected to one lead of each light source. A circular slip ring 66 is seated on an insulated plastic tubular wall 68 to make electrical contact with the other lead of each light source 18 and with the second electrical contact 36 on the bottom housing portion 20.

In this manner, an electrical circuit is completed between the light sources 18 and the switch 26 when the asymmetrical bottom and top portions 20, 22 are screwed together to form spherical housing 12. A parting line 70 (FIG. 7) is thus formed between the upper and lower housing portion 20, 22. The light sources are selectively operated via push button on-off switch actuator 24.

Figure 7:
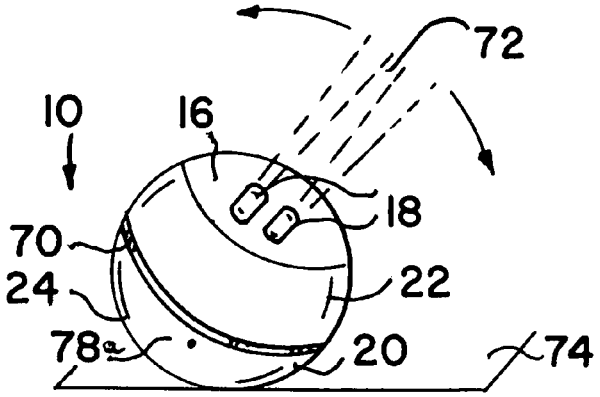
FIG. 7 is a schematic view of the light of FIG. 1, projecting a wobbling light beam.

As seen in FIG. 7, the light 10 is designed such that at rest on a flat horizontal surface, the light sources 18 will project a light beam 72 upwardly at an angle from the surface 74 upon which the light 10 sits. This is accomplished by designing the center of gravity 78*a* (FIGS. 2 and 7) of light 10 in the lower hemisphere of housing 12 offset and eccentric with respect to the geometric center of the spherical housing 12.

Figure 8:
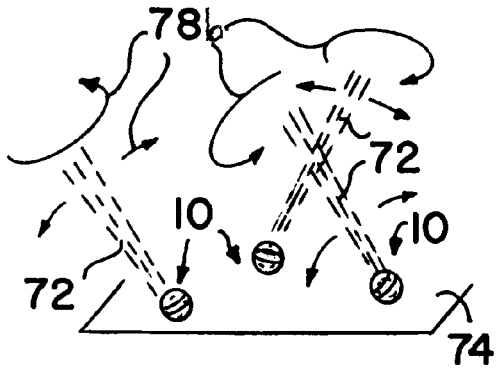
FIG. 8 is a schematic view of a group of lights deployed in a typical tactical application.

In use, one or more lights 10 may be turned on by depressing the switch actuator plunger 24. The lights 10 may then be thrown by hand into a room so that they roll, bounce, slide, spin and wobble across the floor 74. As seen in FIG. 8, the light beams 72 produce a random moving pattern of light as indicated by the directional arrows 78*b*. It has been found that this random pattern of light can cause temporary blindness and disorientation to a degree which can immobilize or incapacitate a person.

Figure 9:
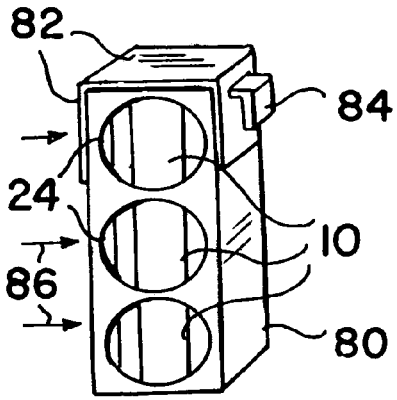
FIG. 9 is a schematic view of a pouch for holding a number of lights, with the side panel of the pouch removed for clarity.

A group of lights 10 is shown in FIG. 9 nested in series in a magazine pouch 80. Pouch 80 can be formed of rigid or flexible material. A releasable cover flap 82 is provided to allow for selective access to the lights 10 snugly stored in the magazine pouch 80. A belt loop or clip 84 can be provided for conveniently carrying one or more magazines of lights 10 on one's person.

The lights 10 may be loaded in a linear series into the magazine pouches 80 with a light friction fit so that the actuators 24 are aligned with openings through the walls of pouch 80 or with indicia on pouch 80. This allows a user to turn on the lights 10 through these operating portions of the pouch while the lights are still in their magazine pouches 80. Openings in the pouch sidewall are required for rigid pouches, but simple indicia markings can be provided on flexible fabric pouches to indicate the location of the switch actuators 24 within the pouches so as to allow for depression of actuators 24 through the fabric, as represented by directional arrows 86 in FIG. 9.

Figure 12:
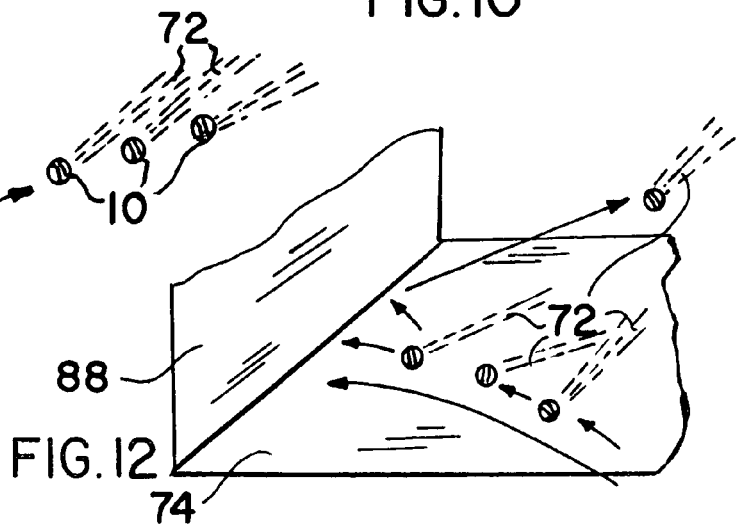
FIG. 12 is a schematic perspective view of a series of lights released in an arc such as produced by a sweeping release from the pouch of FIG. 9.

Once turned on within the pouch 80, the brightly illuminated lights 10 cannot be seen outside of the pouch, but can be thrown by a user directly out of the pouch 80 and then become visible. In this manner, a number of lights 10 can be deployed with a single toss or throw. A sweeping arcuate horizontal swing or throw can release the lights 10 from pouch 80 in a sweeping series of trajectories as shown in FIG. 12. As the lights 10 bounce off a wall 88 or off a piece of furniture, the light beams 72 can be particularly effective in disorienting a person in the room. The pouch 80 is typically retained in the hand of the user after the lights 10 are hurled from the pouch and can thus be refused, as can the lights 10.

Figure 10:
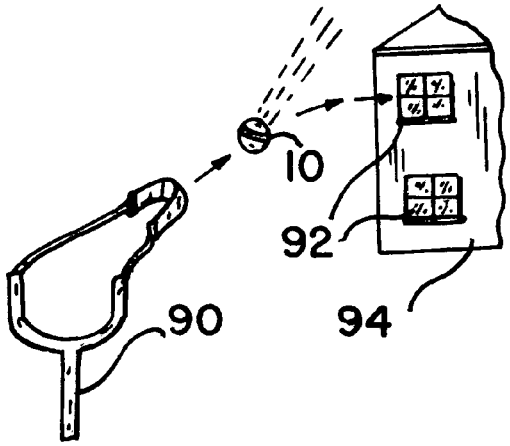
FIG. 10 is a schematic perspective view of a light deployed by a slingshot.

While hand throws are effective for short to medium range use of lights 10, a mechanical projector can be used for longer range applications as well as short and medium range applications. For example, a sling or slingshot 90 (FIG. 10) can be used to project one or more lights 10 over longer distances and at higher velocities than those achievable by hand. In this case the lights 10 can be shot through upper and lower windows 92 of a building 94. Even exotic instruments such as crossbows can be easily adapted to project lights 10.

Figure 11:
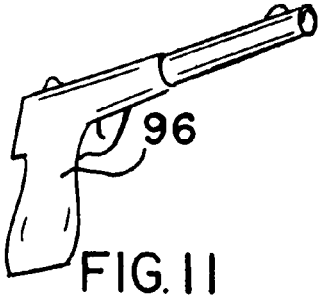
FIG. 11 is a schematic perspective view of a series of lights deployed by a handgun.
Figure 13:
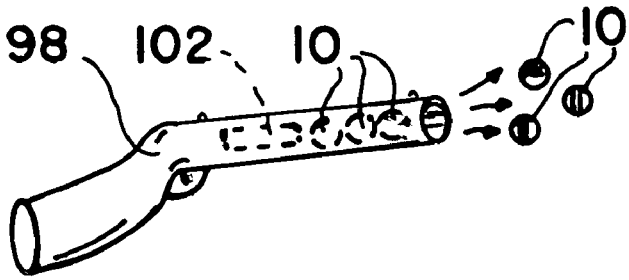
FIG. 13 is a schematic view of a group of lights simultaneously released from a rifle or shotgun.
Figure 16:
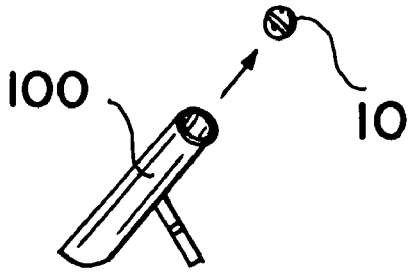
FIG. 16 is a schematic view of a mortar firing a light.

Lights 10 can also be projected by spring, compressed gas or gunpowder using a suitable device such as a handgun 96 (FIG. 11), a rifle or shotgun 98 (FIG. 13), or a cannon or mortar 100 (FIG. 16). In FIG. 13, a group of lights 10 can be released with a single shot or individually in a series of shots. Compressed gas, such as provided in carbon dioxide cylinders 102 (FIG. 13), can be used effectively in this application.

Figure 14:
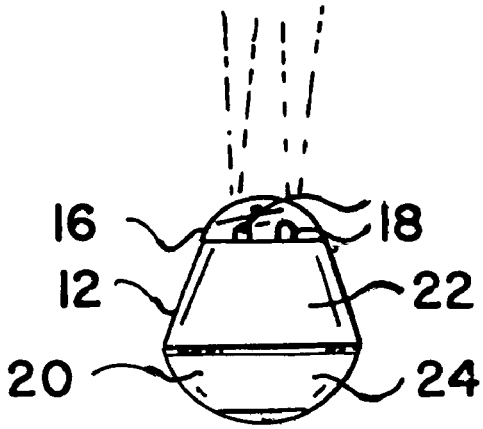
FIG. 14 is a side elevation view of another embodiment of light.
Figure 15:
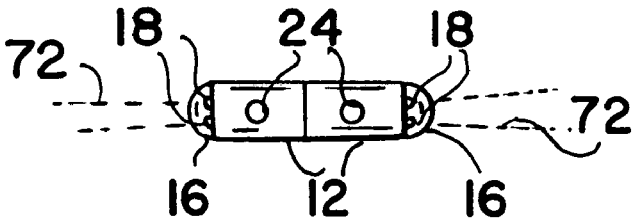
FIG. 15 is a side elevation view of a cylindrical form of dual light.

While spherical lights 10 have been described, it should be noted that virtually any shape of light can be used. For example, a somewhat bell-shaped housing 12 (FIG. 14) can be used effectively, as can a cigar-shaped housing 12 (FIG. 15). In FIG. 15, two sets of light sources are provided, one at each end of housing 12. In each example the rugged robust construction of the housing 12 and each of the internal components within the housing are constructed to be easily portable, projectable or thrown through the air and operate after impact and landing by projecting a beam of light 72.

While white light, or light which is visible to the human eye is effective in many applications as described above, in some situations, it is advantageous to provide a light source 18 that cannot be seen by the unaided human eye. An example of such an application is the use of one or more lights 10 for "marking" a room in a building or cell in a prison or jail that is being checked and cleared for hostile entities. When these operations take place in dark places or at night, law enforcement agents and tactical military forces may use "night vision" goggles to see in the dark. These goggles can receive and amplify infrared light and convert it to light which is visible to humans.

When a room or cell has been checked out and found to be safe or "clear", one or more lights 10 provided with an infrared light source 18 are thrown into the room or cell to alert others wearing night vision goggles that the room or cell is safe or clear and need not be checked out again.

In those cases where a hostile individual is wearing night vision goggles, it is possible to temporarily stun, blind and/or disorient that individual by throwing or otherwise projecting one or more lights 10 provided with infrared light sources 18 into the room or area a surrounding that individual. The results are similar to those described above when using white light sources 18 around individuals without night vision goggles.

In addition to serving as a marker device, the light 10 can also provide a degree of low level light to illuminate a room to help law enforcement and military to see if there are any hostile individuals or other hostile forces in the room or other infrared illuminated area. Visible or white light sources 18 can be used for this purpose, as can infrared light sources 18 or a combination of both. Either visible or infrared lights 10 can also be used to "visibly" mark an outdoor area, such as unlit or remote aircraft landing sites and runways.

Figure 6:
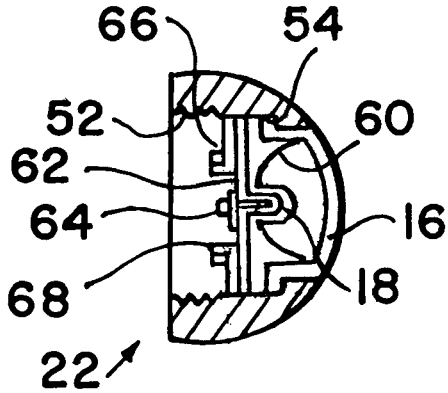
FIG. 6 is a view in section along line 6-6 of FIG. 5.

Infrared light emitting diodes (LEDs) are commercially available for both "through hole" mounting and for surface mounting on a circuit board or insulator such as insulator plate 62 (FIG. 6). White light LEDs typically provide a beam of light 72 in the wavelength range of about 400 to 700 nanometers which is visible to the unaided or "naked" human eye. Infrared LEDs can provide a beam of light in a higher wavelength range of about 750 to 1000 nanometers which is only visible with light receivers such as night vision goggles or other apparatus which converts infrared light into visible light.

Ultraviolet wavelength light sources 18 may also be used with the lights 10 to operate at light wavelengths below visible light. These light sources 18 may also be provided in the form of LEDs and require ultraviolet receivers to convert ultraviolet light to visible light to enable the human eye to detect this light. The ultraviolet lights 10 can be used in the same manner as described above.

The lights 10 are not limited to use by law enforcement and military. Hunters and other sportsmen have found many users for the lights 10 for both illumination and as light markers. Of course, light 10 can be used for basic illumination in the manner of a flashlight such as in the dark and in homes during power outages. While "button" type batteries 30 are shown in the drawings (FIG. 3), virtually any type of battery may be used with appropriate configuration of the light 10, whether white light, ultraviolet or infrared LED's are powered by the battery.

There has been disclosed heretofore the best embodiments of the disclosure as presently contemplated. Obviously, numerous modifications and variations of the present disclosure are possible in light of the above teachings. It is therefore to be understood that within the scope of the appended claims, the embodiments may be practiced otherwise than as specifically described herein.

While the invention is susceptible to alternative constructions, certain embodiments thereof have been described above in detail. It should be understood, however, that there is no intention to limit the disclosure to the specific form or embodiments disclosed, but on the contrary, the intention is to cover all modifications, alternative constructions, and equivalents falling within the spirit and scope of the disclosure, as defined in the appended claims.

What is claimed is:

1. A portable electric light, comprising:

a spherical housing comprising a first housing portion and a second housing portion, said first and second housing portions respectively comprising first and second screw threads;

said first and second housing portions comprising a releasable threaded interconnection between said first and second screw threads;

an elastomeric seal disposed between said first and second housing portions providing a water-tight seal therebetween when said first and second housing portions are interconnected via said releasable threaded interconnection;

said first housing portion comprising a light transmitting spherical surface portion;

a manually-activated switch provided in said spherical housing;

a battery disposed within said spherical housing;

a light emitting diode provided in said housing powered by said battery and controlled by said manually-actuated switch; and said light having an eccentric center of gravity such that when said light is at rest on a flat horizontal surface, said light emitting diode projects a beam of light through said light transmitting spherical surface portion and upwardly from said horizontal surface.

2. The light of claim 1, further comprising a strobe light circuit disposed within said housing.

3. The light of claim 1, wherein said elastomeric seal comprises an o-ring.

4. The light of claim 1, wherein said light emitting diode comprises an infrared light emitting diode.

* * * * *